United States Patent [19]

Wooding et al.

[11] 4,172,303

[45] Oct. 30, 1979

[54] CLEANING STATION

[75] Inventors: David L. Wooding; Robert W. Pletcher, both of Rochester, N.Y.

[73] Assignee: Eastman Kodak Company, Rochester, N.Y.

[21] Appl. No.: 892,719

[22] Filed: Apr. 3, 1978

[51] Int. Cl.[2] ..... G03G 21/00

[52] U.S. Cl. ..... 15/256.52; 118/652; 355/15

[58] Field of Search ..... 15/256.52; 118/652; 355/15; 101/425; 134/6

[56] References Cited

U.S. PATENT DOCUMENTS

| | | | |
|---|---|---|---|
| 3,089,415 | 5/1963 | Grembecki et al. | 101/425 |
| 3,644,959 | 2/1972 | Ohta | 15/256.52 |
| 3,955,533 | 5/1976 | Smith et al. | 355/15 |

*Primary Examiner*—Edward L. Roberts

*Attorney, Agent, or Firm*—Raymond L. Owens

[57] ABSTRACT

In electrographic apparatus having a cleaning station with a rotating cleaning brush which removes residual toner from a reusable imaging surface, a rotating comb has bristles in engagement with the brush. The bristles of the comb are arranged in two opposed helical segments for removing toner particles from the brush and for transporting such toner particles along a path to a collecting region to facilitate their effective removal by a vacuum system.

4 Claims, 4 Drawing Figures

CLEANING STATION

BACKGROUND OF THE INVENTION

1. Field of the Invention

This invention relates to electrographic imaging apparatus and, more particularly, to an improved cleaning station for removing residual toner from an imaging surface.

2. Description of the Prior Art

Cleaning of residual particles from a reusable imaging surface of a photoreceptor in electrographic copiers is well known. In xerography, for example, a latent electrostatic image is optically formed on the imaging surface of the photoreceptor. This latent image is developed by depositing on it a charged finely divided, dry, electroscopic visible image developer material known in the art as toner. This developed toner image is then electrostatically transferred and permanently fixed to a support surface such as paper. However, after such transfer, residual toner remains on the photoreceptor. The residual toner is tightly retained on the photoreceptor surface and is difficult to remove. This retention is believed to be caused both by electrical charge attractions and other forces that prevent complete transfer of the toner to the imaging surface. Since residual toner can cause imperfections in subsequent copies, cleaning of residual toner from the photoreceptor must be accomplished rapidly and thoroughly.

Conventional photoreceptor cleaning stations typically include one or more rotatable cleaning brushes which frictionally scrub the imaging surface of the photoreceptor to remove residual toner from it. The removed toner is then exhausted by a vacuum system.

The vacuum system may not remove all the toner from the cleaning brush, and the brush may accumulate toner to such extent that it becomes overloaded with toner. An overload cleaning brush can deposit toner back onto the photoreceptor and cause a dark background on copy sheets. Further, an overloaded cleaning brush can scratch the photoreceptor. Still further, an overloaded brush can produce a cloud of toner dust which can leak out of the cleaning station and contaminate other machine components.

Various structures have been employed to aid vacuum systems in removing toner from cleaning brushes. One such structure is a stationary flicker bar that deformably engages the brush nap to mechanically remove toner from it. Flicker bars, however, tend to generate clouds of the toner dust which can cause machine contamination.

U.S. Pat. No. 3,644,959 discloses an arrangement, somewhat similar to a flicker bar structure, wherein toner is removed from a cleaning brush by means of a plurality of rotatable thin disks which agitate the nap of the cleaning brush. Such an arrangement can create a significant amount of toner dust which can escape out of the cleaning station and damage vital machine components.

SUMMARY OF THE INVENTION

The present invention is concerned with removing toner particles from a cleaning brush and transporting such removed toner to a collecting region for efficient removal by a vacuum system or the like.

In accordance with this invention, there is provided a cleaning brush which has a nap that engages a photoreceptor to remove residual toner particles from it. A rotatable comb is provided with bristles which engage the cleaning brush nap, remove toner particles from the nap and transport these removed particles along a path to a collecting region to facilitate their removal by a vacuum system.

In the preferred embodiment, the comb bristles are arranged in two opposed helical segments, each of which extends from the center to an end of the comb. These segments transport toner particles to the collecting region which is disposed between the segments.

DESCRIPTION OF THE PREFERRED EMBODIMENT

Figure 1:
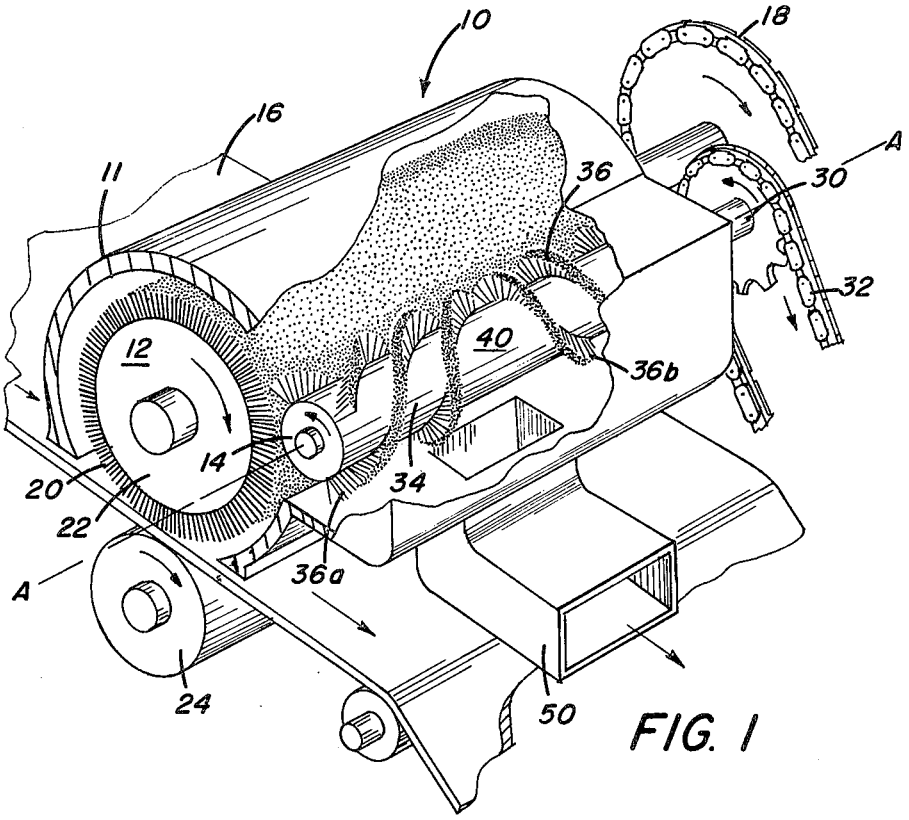
FIG. 1 is a perspective view, partially broken away, of a cleaning station embodying the invention.
Figure 2:
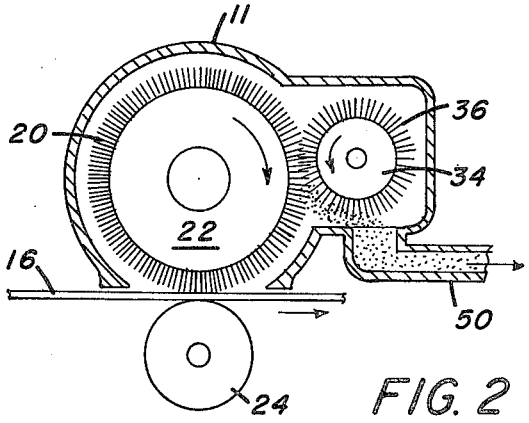
FIG. 2 is a schematic, cross-sectional representation of the cleaning station shown in FIG. 1.
Figure 3:
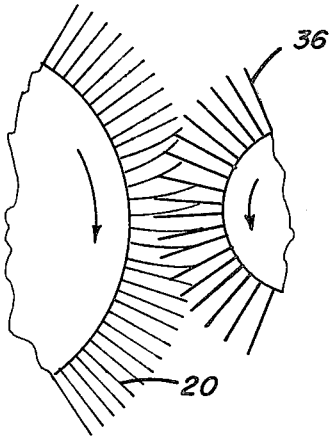
FIG. 3 is a partial, schematic view similar to FIG. 2, showing the comb engaging the cleaning brush.

Referring to FIG. 1 there is shown a cleaning station 10 which includes a housing 11 containing a rotatable cleaning brush 12 and a rotatable comb 14. Residual toner is carried on an insulating imaging surface of a moving reusable photoreceptor 16 as it enters the cleaning station 10. The photoreceptor 16 is shown as a web. Often this photoreceptor is referred to in the art as a photoconductor or a film. As will be well understood by those skilled in the art, the photoreceptor could also be in the form of a rigid member such as a drum or plate. The cleaning brush 12 is driven by a chain drive 18 connected to a source of power (not shown) and scrubs the imaging surface of the photoreceptor for removing residual toner material from such surface. Towards this end, bristles 20 are provided on the surface of a cylindrical member 22 of the cleaning brush and press the photoreceptor 16 against a back-up roller 24. The force of contact between the brush 12 and the photoreceptor 16 assures complete removal of the residual toner from the photoreceptor. The bristles of the cleaning brush may be made of synthetic fibers such as nylon, or of natural materials such as furs of rabbits, feathers, untwisted silk fabrics or the like.

A substantial portion of the removed toner will be normally retained in the fibers of the cleaning brush 12 and must be removed therefrom. The comb 14 provides this function in an improved manner.

The comb 14 includes a rotatable shaft 30, journalled in the housing 11. The shaft 30 rotates about its axis A-A and is driven by a chain drive 18 connected to a source of power (not shown). A cylindrical member 34 is fixed to the shaft 30 and rotates with it. Bristles 36 are secured in the outer surface of the cylindrical member 34. The bristles 36 may be made of a synthetic material such as nylon. The bristles 36 are arranged in two spaced helical screw-type segments **36*a* and 36*b*, each of which extends from the center to opposite ends of the comb 14. The helix of each segment is disposed so that upon rotation of the cylinder 34, the screw advance of each of these segments is towards a central collecting region 40. As shown, the collecting region 40 is formed between these two spaced segments. The bristles of the comb 14** operating as a screw impart forces on the toner particles causing them to move along a path, adjacent the surface of the cylindrical member 34 to the collection region 40. (See FIG. 4).

Preferably, the comb 14 should rotate in a direction opposite to that of the brush 12 and at an angular velocity from between about twenty-five to fifty percent greater than the angular velocity of the brush 12. The opposite directions of rotation of the brush 12 and comb 14 aids in removing toner from the brush 12. The difference in velocity between the brush 12 and comb helps to reduce the tendency of the cleaning brush fibers to matt. The preferred angular velocity of the brush can be determined experimentally, taking into consideration factors such as the diameter of the brush and the speed of travel of the photoreceptor 16.

Figure 4:
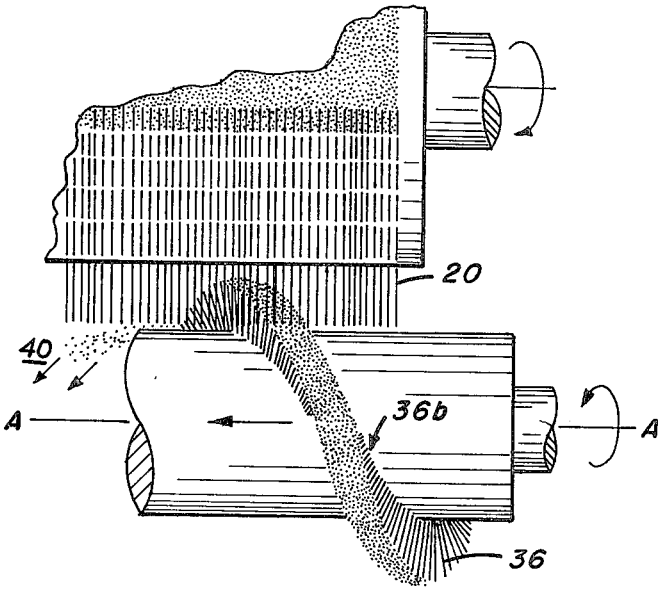
FIG. 4 is an enlarged, partial view of engaging portions of the cleaning brush and comb.

As shown in FIG'S. 3 and 4, the bristles 36 are made significantly stiffer then the bristles 20 on the cleaning brush 12 to aid in removing toner from the bristles 20. Simultaneously with removal of toner particles, the bristles 36 also vigorously fluff the nap of the cleaning brush 14 to prevent matting. As best shown in FIG. 4, as the comb rotates, the bristles 36 remove toner from the cleaning brush bristles and because of the screw advance of the segment 36*b* transport the particles along a path toward the collection region 40. A duct 50 which opens into the housing 11 just below the collecting region 40 is connected to a source of vacuum, not shown. Toner delivered to the collecting region 40 is carried by air currents created by the vacuum source into the duct 50 and exhausted. This facilitates removal of toner and minimizes the creation of toner dust which can leak out of the cleaning station.

Some of the toner removed by the comb 14 may not be transported to the collection region 40, but may fall downwardly towards the bottom wall of the housing 11. It is also picked up and exhausted by air currents flowing through the duct 50.

The invention has been described in detail with particular reference to a preferred embodiment thereof, but it will be understood that variations and modifications can be effected within the scope and spirit of the invention.

We claim:

1. For use in an electrographic cleaning station including a rotatable cleaning brush having a nap which scrubs the imaging surface of a reusable photoreceptor for removing residual toner particles from such surface, an improved brush cleaning means comprising:

a rotatable comb including bristles which are arranged to form at least one, helical screw-type segment, said comb bristles engaging said cleaning brush nap for removing toner particles from said cleaning brush and transporting such particles along a path to a collecting region, to thereby facilitate their removal.

2. For use in an electrographic cleaning station including a rotatable brush having a cleaning nap which scrubs the imaging surface of a reusable photoreceptor for removing residual toner particles from such surface, and means for connecting a source of vacuum to said cleaning station, an improved brush cleaning means comprising:

a rotatable comb having bristles which engage said cleaning brush nap, said bristles being arranged in two opposed, helical screw-type segments forming a central collecting region between such segments with the screw advance of each of these segments being towards said collecting region, whereby upon rotation of said comb, said bristles remove toner from said cleaning brush nap and transport such toner particles to the collecting region to facilitate their effective removal by said vacuum connecting means.

3. The invention as set forth in claim 2 wherein said cleaning brush and said comb rotate in opposite directions, with the angular velocity of said comb being selected to be about twenty-five to fifty percent greater than the angular velocity or said cleaning brush.

4. The invention as set forth in claim 3 wherein said cleaning brush bristles are stiffer than said brush nap.

* * * * *